US011772289B2

(12) United States Patent
Paauw et al.

(10) Patent No.: US 11,772,289 B2
(45) Date of Patent: Oct. 3, 2023

(54) HAIR GUIDE AND HAIR CUTTING ASSEMBLY

(71) Applicant: KONINKLIJKE PHILIPS N.V., Eindhoven (NL)

(72) Inventors: Hendrik Klaas Paauw, Roden (NL); Michael Reece Jenkins, Amsterdam (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 130 days.

(21) Appl. No.: 17/053,812

(22) PCT Filed: May 1, 2019

(86) PCT No.: PCT/EP2019/061168
§ 371 (c)(1),
(2) Date: Nov. 9, 2020

(87) PCT Pub. No.: WO2019/228740
PCT Pub. Date: Dec. 5, 2019

(65) Prior Publication Data

US 2021/0260779 A1 Aug. 26, 2021

(30) Foreign Application Priority Data

May 30, 2018 (EP) ..... 18175108

(51) Int. Cl.
*B26B 19/38* (2006.01)
*B26B 19/20* (2006.01)

(52) U.S. Cl.
CPC ..... *B26B 19/3813* (2013.01); *B26B 19/20* (2013.01); *B26B 19/3806* (2013.01)

(58) Field of Classification Search
CPC ..... B26B 19/14; B26B 19/145; B26B 19/20; B26B 19/38; B26B 19/3806; B26B 19/3813; B26B 19/3826; B26B 19/3846
(Continued)

(56) References Cited

U.S. PATENT DOCUMENTS 2,616,169 A 11/1952 Reinout
2,932,891 A * 4/1960 Waggoner ..... B26B 19/3813 30/537

(Continued)

FOREIGN PATENT DOCUMENTS

CN 202264244 6/2012
CN 102733134 10/2012

(Continued)

OTHER PUBLICATIONS

International Search Report and Written Opinion Dated Jul. 29, 2020 For International Application No. PCT/EP2019/061168 Filed May 1, 2019.

*Primary Examiner* — Jason Daniel Prone

(57) ABSTRACT

A hair guide for a hair cutting assembly comprising a cutting unit support member and at least two cutting units, each having an external cutting member and an internal cutting member rotatable relative to the external cutting member about an axis of rotation, the external cutting member having an annular cutting zone comprising hair-entry openings provided at least in a main annular wall of the cutting zone, each cutting unit being pivotable relative to the cutting unit support member. The hair guide comprising:

a hair guide support member coupled to the cutting unit support member of the hair cutting assembly, and at least two annular hair guiding members each having a central axis and a plurality of hair guiding elements having a main direction of extension in a radial direc- (Continued)

tion relative to the central axis and arranged in an annular hair guiding zone extending about the central axis.

15 Claims, 7 Drawing Sheets

(58) Field of Classification Search
USPC ..... 30/43.4–43.6
See application file for complete search history.

(56) References Cited

U.S. PATENT DOCUMENTS

| | | | | | |
|---|---|---|---|---|---|
| 3,008,233 | A * | 11/1961 | Waggoner | B26B 19/3813 | 30/537 |
| 3,107,423 | A | 10/1963 | Caesar | | |
| 3,109,236 | A * | 11/1963 | Wolf | B26B 19/20 | 30/537 |
| 4,003,390 | A * | 1/1977 | Solie | B26B 19/20 | 132/213 |
| 4,888,870 | A * | 12/1989 | Fujikawa | B26B 19/20 | 30/233.5 |
| 5,621,971 | A | 4/1997 | Szymansky | | |
| 10,456,937 | B2 * | 10/2019 | Veldhuis | B26B 19/20 | |
| 11,141,871 | B2 * | 10/2021 | Paauw | B26B 19/3813 | |
| 2007/0124936 | A1 | 6/2007 | Okabe | | |
| 2008/0040935 | A1 * | 2/2008 | Gratz | B26B 19/20 | 30/539 |
| 2015/0040403 | A1 * | 2/2015 | Campbell | B26B 19/3846 | 30/43.6 |
| 2017/0190063 | A1 | 7/2017 | Schratter | | |
| 2021/0122069 | A1 * | 4/2021 | Ohara | B26B 19/145 | |

FOREIGN PATENT DOCUMENTS

| | | | | |
|---|---|---|---|---|
| EP | 1231034 | | 8/2002 | |
| EP | 2481535 | | 8/2012 | |
| EP | 3037224 | | 6/2016 | |
| EP | 3300857 | | 4/2018 | |
| EP | 3427909 | A1 * | 1/2019 | B26B 19/3813 |
| EP | 3575049 | A1 * | 12/2019 | B26B 19/20 |
| WO | 2019011685 | | 1/2019 | |
| WO | WO-2019228740 | A1 * | 12/2019 | B26B 19/20 |

* cited by examiner

Prior Art

Prior Art

Prior Art

HAIR GUIDE AND HAIR CUTTING ASSEMBLY

CROSS REFERENCE TO RELATED APPLICATIONS

This application is the U.S. National Phase application under 35 U.S.C. § 371 of International Application No. PCT/EP2019/061168 filed May 1, 2019, which claims the benefit of European Patent Application Number 18175108.2 filed May 30, 2018. These applications are hereby incorporated by reference herein.

TECHNICAL FIELD OF THE INVENTION

The present disclosure relates to a hair guide for a hair cutting assembly.

BACKGROUND OF THE INVENTION

Electric hair cutting devices are widely used to cut body hair and typically include a handle and a cutting head. Rotary cutters are known which comprise an outer cutting member and an inner cutting member which rotates with respect to the outer cutting member so as to perform a cutting operation. In some arrangements, the outer cutting member may comprise a plurality of hair-entry openings, and the inner cutting member may comprise a plurality of sharpened elements, which cut hairs that extend into the hair-entry openings.

In order to guide hairs into the hair-entry openings to be cut, a hair guide may be provided. The hair guide may be arranged so as to manipulate hairs towards the hair-entry openings as the cutting head is moved across the user's skin. Such hair guides may also control a length of the hair to remain after cutting.

In some examples, the outer surface of the hair guide is spaced away from the outer surface of the cutting head by a pre-set distance, such that hairs that are shorter than the pre-set distance are not cut, and hairs that are longer than the pre-set distance are cut, e.g. to be no longer than the pre-set distance. Examples of such hair guides are disclosed in EP2481535A1, where additional grids of varying thicknesses are mountable upon a basic grid of the cutting head to cut hair at a predefined distance from the skin.

However, hair guides of this type can cause pressure peaks on the user's skin as the hair cutting device is used, particularly in convex areas of the skin. Additionally, mounting a grid on top of the existing grid can reduce the reachability of the hair cutting device, particularly near the ears and under the nose.

Furthermore, hair guide of this type can also obstruct access for hairs to the cutting members of the hair cutting device, thereby reducing cutting efficiency, increasing the time taken for hair cutting and increasing skin irritation caused by hair cutting.

SUMMARY OF THE INVENTION

According to an aspect of the present invention, there is provided a hair guide for a hair cutting assembly, wherein the hair cutting assembly comprises a cutting unit support member and at least two cutting units, wherein each cutting unit has an external cutting member and an internal cutting member which is rotatable relative to the external cutting member about an axis of rotation, the external cutting member having an annular cutting zone comprising hair-entry openings provided at least in a main annular wall of the cutting zone, and wherein each cutting unit is pivotable relative to the cutting unit support member, said hair guide comprising:

a hair guide support member configured to be coupled to the cutting unit support member of the hair cutting assembly, and at least two annular hair guiding members each having a central axis and a plurality of hair guiding elements having a main direction of extension in a radial direction relative to the central axis and arranged in an annular hair guiding zone extending about the central axis, wherein:

each annular hair guiding member is arranged relative to the hair guide support member such that, when the hair guide support member is coupled to the hair cutting assembly, the annular hair guiding member is associated with a respective one of the at least two cutting units of the hair cutting assembly such that the plurality of hair guiding elements partially cover the main annular wall of the respective cutting unit, and each annular hair guiding member is pivotable relative to the hair guide support member such that, when the hair guide support member is coupled to the hair cutting assembly, the annular hair guiding member is pivotable together with the respective cutting unit.

By arranging the annular hair guiding members to be pivotable relative to the hair guide support member, the annular hair guiding members are able to pivot together with the cutting units of the hair cutting assembly in order to conform to the shape of the user's skin during shaving. This reduces peaks in the pressure being applied to the user's skin during hair cutting, particularly when cutting hair on convex areas of skin.

Distal portions of the hair guiding elements may extend in a direction with a component away from an external surface of the external cutting member, e.g. the main annular wall, of the respective cutting unit, when the hair guide support member is coupled to the hair cutting assembly. For example, the distal portions of the hair guiding elements may extend away from the external surface of the external cutting member with a component in a direction parallel with the axis of rotation of the corresponding cutting unit.

The distal portions of the hair guiding elements may thereby be arranged to lift hairs and guide them towards the hair entry openings of the external cutting members, regardless of the angle at which the annular hair guiding members have pivoted to.

The distal portions of the hair guiding elements may be portions of the hair guiding elements inward of the main annular wall of the external cutting elements relative to the axis of rotation of the cutting units. Alternatively, part of the distal portion may be aligned with, e.g. radially aligned with, the main annular wall.

Each respective annular hair guiding member may be pivotable about a pivot axis different from the pivot axes of the other annular hair guiding members. The pivot axis of each annular hair guiding members may be aligned with a pivot axis of the respective cutting unit when the hair guide support member is coupled to the hair cutting assembly. In one or more arrangements, each respective annular hair guiding member may be pivotable about a pivot axis which is arranged perpendicular to a line extending from a centre of the respective annular hair guiding member to a centre point between the annular hair guiding members. The hair guide may comprise three annular hair guiding members, wherein each of the annular hair guiding members is pivotable about a pivot axis which is arranged at 120 degrees relative to the pivot axes of the other annular hair guiding members.

Configuring the annular hair guiding members in this way is beneficial in enabling the outer surfaces of the annular hair guiding members to form a concave or convex surface depending on the angle to which the annular hair guiding members are pivoted.

The hair guide support member may be configured to be detachably couplable to the cutting unit support member of the hair cutting assembly. Alternatively, the hair guide support member may be configured to be detachably couplable to a handle for a hair cutting appliance, such that the hair guide support member is positioned over the cutting unit support member.

The annular cutting zone of each cutting unit may further comprise an inner side wall which surrounds a central wall portion of the external cutting member. The central wall portion may be recessed relative to the main annular wall at least in an annular recessed area adjacent to the inner side wall. At least one of the hair guiding elements of each annular hair guiding member may have an inwardly directed rounded end portion. The inwardly directed rounded end portion may be arranged at a distance from the central axis such that, when the hair guide support member is coupled to the hair cutting assembly, the rounded end portion is positioned, in a radial direction relative to the central axis, at least partially inwardly of the inner side wall of the respective cutting unit. Additionally or alternatively, the inwardly directed rounded end portion may be arranged such that, when the hair guide support member is coupled to the hair cutting assembly, the rounded end portion is positioned, in an axial direction relative to the central axis, at a distance from the annular recessed area of the respective cutting unit.

According to another aspect of the present invention, a hair cutting assembly comprises a hair guide as described here above, and further comprises a cutting unit support member and at least two cutting units, wherein each cutting unit has an external cutting member and an internal cutting member which is rotatable relative to the external cutting member about an axis of rotation, the external cutting member having an annular cutting zone comprising hair-entry openings provided at least in a main annular wall of the cutting zone, and wherein each cutting unit is pivotable relative to the cutting unit support member, wherein the hair guide support member is arranged in a fixed position relative to the cutting unit support member. For example, the hair guide support member may be integrally formed with the cutting unit support member.

Each annular hair guiding member may comprise an annular support element surrounding and supporting the respective cutting unit and being pivotable relative to the hair guide support member. The hair guiding elements of the annular hair guiding member may be arranged in stationary positions relative to the annular support element.

According to another aspect of the present invention, a hair cutting apparatus comprises a hair cutting assembly as described here above, and further comprises a main body, such as a handle, accommodating an actuator for rotatably driving the internal cutting members of the cutting units of the hair cutting assembly. The hair cutting assembly may be releasably coupled to the main body.

According to another aspect of the present invention, there is provided a kit of parts for a hair cutting system, the kit comprising:

a hair cutting apparatus comprising a cutting unit support member and at least two cutting units, wherein each cutting unit has an external cutting member and an internal cutting member which is rotatable relative to the external cutting member about an axis of rotation, the external cutting member having an annular cutting zone comprising hair-entry openings provided at least in a main annular wall of the cutting zone, and wherein each cutting unit is pivotable relative to the cutting unit support member, the hair cutting apparatus further having a main body accommodating an actuator for rotatably driving the internal cutting members of the cutting units; and a hair cutting accessory comprising a hair guide as described here before, wherein the hair guide support member is configured to be detachably coupleable to the cutting unit support member of the hair cutting apparatus.

According to another aspect of the present invention, there is provided a kit of parts for a hair cutting system, the kit comprising:

a first hair cutting accessory comprising a cutting unit support member and at least two cutting units, wherein each cutting unit has an external cutting member and an internal cutting member which is rotatable relative to the external cutting member about an axis of rotation, the external cutting member having an annular cutting zone comprising hair-entry openings provided at least in a main annular wall of the cutting zone, and wherein each cutting unit is pivotable relative to the cutting unit support member; and a second hair cutting accessory comprising a hair cutting assembly as described here before, wherein the hair-entry openings of the cutting units of the hair cutting assembly of the second hair cutting accessory have a greater width than the hair-entry openings provided in the cutting units of the first hair cutting accessory.

Providing the cutting units of the second hair cutting accessory with hair entry openings of greater width improves the performance, e.g. speed, of the cutting units in cutting the user's hair. Because the cutting units of the second hair cutting accessory do not directly contact the user's skin, comfort is not affected.

The kit may further comprise a main body, such as a handle, accommodating an actuator for rotatably driving the internal cutting members of the cutting units of the first and second hair cutting accessories. The first and second hair cutting accessories may be interchangeably couplable to the main body, e.g. such that one of the first and second hair cutting accessories can be rotatably driven by the main body actuator.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment of the invention.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION OF EMBODIMENTS

Figure 1:
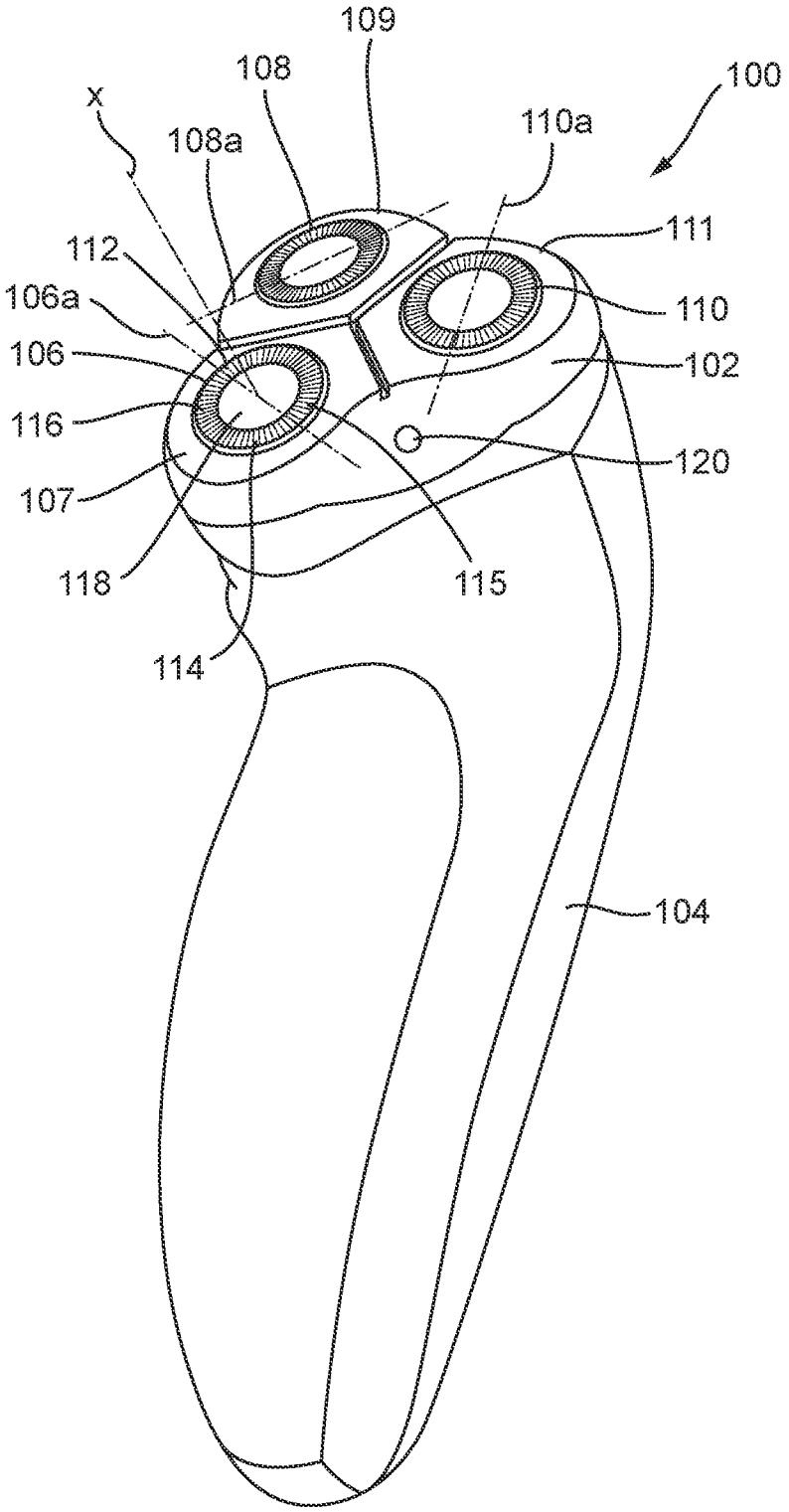
FIG. 1 is a schematic perspective view of a prior art hair cutting apparatus, which is useful for understanding the present invention.

FIG. 1 generally shows a prior art hair cutting apparatus 100, in the form of an electric rotary shaver. The hair cutting apparatus 100 comprises a cutting unit support member 102 attached to a main body or handle 104.

The cutting unit support member 102 supports first, second, and third cutting units 106, 108, 110, in the form of rotary cutters. The cutting units 106, 108, 110 are arranged in openings of an upper face of the cutting unit support member 102 in a substantially triangular arrangement. The cutting units 106, 108, 110 are pivotable relative to the cutting unit support member 102 in order to better conform to a user's face during shaving.

The cutting units 106, 108, 110 are pivotable relative to the cutting unit support member 102 such that outer, e.g. external, surfaces of the cutting units can define portions of a concave or convex surface. For example, the cutting units 106, 108, 110 may be configured to pivot about respective pivot axes 106*a*, 108*a*, 110*a* that are arranged to be perpendicular to lines from the centres of each particular cutting unit, to a centre point between all of the cutting units 106, 108, 110. In the arrangement shown in FIG. 1, in which three cutting units are provided, the pivot axes are arranged 120 degrees relative to each other. The cutting units are thereby configured to tilt towards or away from the centre point between all of the cutting units in order to define a concave or convex surface between them.

Each cutting unit 106, 108, 110 is substantially identical in form and function and so only one of the cutting units 106 will be described in detail and this description should be equally applicable to the other two cutting units 108, 110.

The cutting unit 106 comprises an external cutting member 112. An internal cutting member is arranged beneath the external cutting member 112. The internal cutting member is rotatable relative to the external cutting member about an axis of rotation x. The internal cutting member can be driven to rotation by an actuator, such as an electric motor, accommodated the handle 104. The external cutting member 112 further comprises an annular cutting zone 114.

The annular cutting zone 114 comprises a main annular wall 115 wherein a plurality of hair-entry openings 116 is provided. The hair-entry openings 116 permit hairs to extend into the cutting unit 106 in order to be cut between cutting edges of the hair-entry openings 116 and cutting edges of the rotating internal cutting member. The hair-entry openings 116 are sized and shaped to provide a well-balanced shaving performance. In particular, the hair-entry openings 116 are sized and shaped to permit the hairs to enter, whilst preventing skin from contacting the internal cutting member, thereby reducing irritation of the skin during shaving.

The cutting units 106, 108, 110 will be described in more detail below with reference to FIG. 4.

The cutting unit support member 102 supports the cutting units 106, 108, 110 by means of skin support rims 107, 109, 111, which extend around each of the respective cutting units 106, 108, 110 and extend an outer surface of the cutting unit support member around the cutting units 106, 108, 110.

As the hair cutting apparatus 100 is moved over a user's skin in order to shave their hair, the skin support rims 107, 109, 111 support the skin around the cutting units 106, 108, 110 in order to reduce pressure on the external cutting member 112. The skin support rims 107, 109, 111 also act to tighten the skin ahead of the respective cutting units 106, 108, 110, e.g. in the direction the hair cutting apparatus 100 is being moved over the user's skin, which assists in standing hairs upright, so that they can be cut better and closer by the cutting units 106, 108, 110.

The skin support rims 107, 109, 111 are pivotally coupled to the cutting unit support member 102, such that the skin support rims 107, 109, 111 are able to conform to the shape of the user's face during shaving, in the same way as the cutting units 106, 108, 110. The skin support rims 107, 109, 111 may be configured to pivot together with the respective corresponding cutting units 106, 108, 110. Alternatively, the skin support rims 107, 109, 111 may be configured to pivot independently of the cutting units 106, 108, 110.

The hair cutting apparatus 100 also comprises a coupling member 120 for coupling or engaging with a corresponding coupling member of a hair guide, as described below. In FIG. 1, the coupling member 120 is formed on the cutting unit support member 102. However, it is equally envisaged that coupling members may additionally or alternatively be formed on the handle 104.

Figure 2:
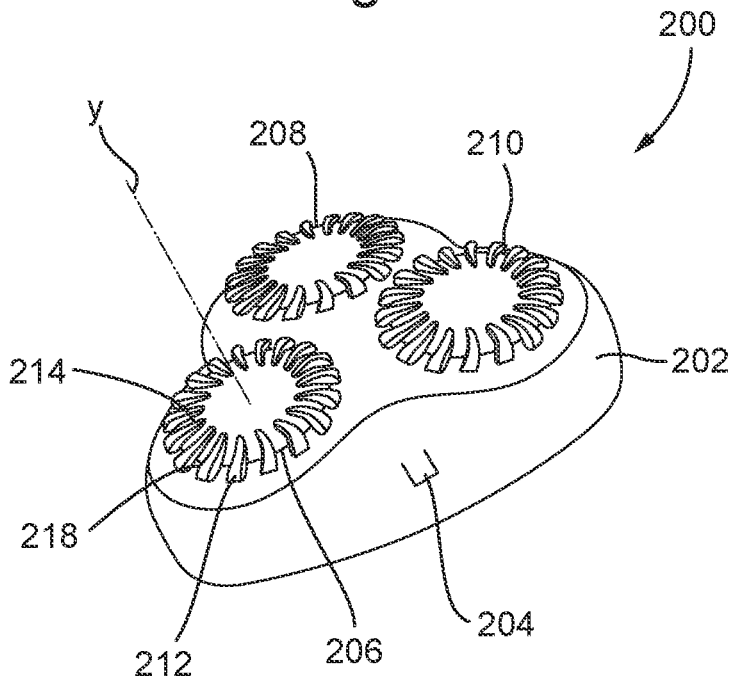
FIG. 2 is a schematic perspective view of a prior art hair guide, which is useful for understanding the present invention.

FIG. 2 shows a prior art hair guide 200 for use with the hair cutting apparatus 100. The hair guide 200 comprises a hair guide support member 202 in the form of a main body of the hair guide 200. An inner surface of support member 202 substantially conforms to the shape of the external surface of the cutting unit support member 102 of the hair cutting apparatus 100. The hair guide support member 202 comprises a coupling member 204 for detachable engagement with the coupling member 120 of the hair cutting apparatus 100 to retain the hair guide 200 in place on the apparatus 100. In this way, the hair guide 200 is configured to be detachably couplable to the cutting unit support member 102 of the hair cutting apparatus 100, so that a user can use the hair cutting apparatus either without the hair guide 200 being coupled to the cutting unit support member 102 or with the hair guide 200 being coupled to the cutting unit support member 102. The coupling members 120, 204 are not shown in detail, but they may be of any suitable form as known to the person skilled in the art, for example in a form providing a snap connection.

The hair guide 200 further comprises three annular hair guiding members, 206, 208, 210. Each of the annular hair guiding members 206, 208, 210 is arranged for co-operation with a respective one of the cutting units 106, 108, 110 when the hair guide 200 is coupled to the cutting unit support member 102. The three annular hair guiding members 206, 208, 210 are substantially identical, so only one of the annular hair guiding members 206 will be described in detail.

The annular hair guiding member 206 has a central axis y which coincides with the axis of rotation x of the cutting unit 106 when the hair guide 200 is coupled to the hair cutting apparatus 100. The annular hair guiding member 206 further comprises a plurality of hair guiding elements 212 arranged circumferentially about a circular aperture 218 of the hair guide support member 202 with equal spacing therebetween.

The hair guiding elements 212 are arranged in an annular hair guiding zone 214 extending about the central axis y, and each have a main direction of extension in a radial direction relative to the central axis y. In the arrangement depicted, the hair guiding elements 212 each extend parallel to the main direction of extension of the particular hair-entry opening 116 which is adjacent to the respective hair guiding element 212 when the hair guide 200 is coupled to the cutting unit support member 102. For example, where the hair-entry openings 116 are linear slots, the hair guiding elements 212 may extend linearly. Alternatively, where the hair-entry openings 116 are arcuate slots, the hair guiding elements 212 may also be arcuate in order to follow the shape of the adjacent hair-entry openings 116 in the radial direction.

Figure 3:
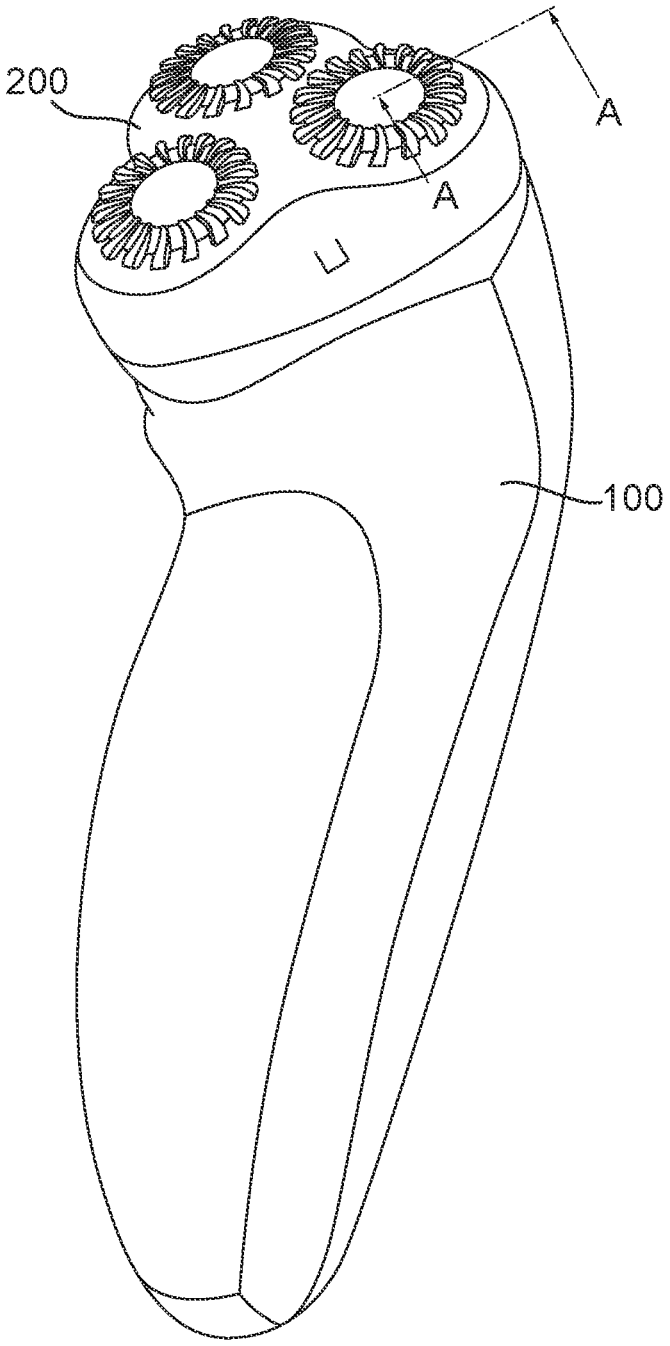
FIG. 3 is a schematic perspective view of a prior art hair cutting system comprising the hair guide of FIG. 2 attached to the hair cutting apparatus of FIG. 1.

As shown in FIG. 3, the prior art hair guide 200 is attachable to the hair cutting apparatus 100 over the cutting unit support member 102 such that the annular hair guiding members 206, 208, 210 of the hair guide 200 align with the cutting units 106, 108, 110 supported by the cutting unit support member 102. In use, the presence of the annular hair guiding members 206, 208, 210 on top of the annular cutting zones 114 of the cutting units 106, 108, 110 increases the distance between the skin and the internal cutting members of the cutting units 106, 108, 110 so that, after being cut, the remaining hairs will have a longer length as compared to hairs that are cut by the cutting units 106, 108, 110 without the use of the hair guide 200. Thus, without the use of the hair guide 200, the hair cutting apparatus 100 has a regular shaving function and, with the use of the hair guide 200, the hair cutting apparatus 100 has a hair trimming function.

The hair guide 200 also functions to better guide hairs into the hair entry openings 116 of the cutting units 106, 108, 110 to improve hair cutting.

The co-operation of the prior art hair guide 200 with the cutting units 106, 108, 110 supported by the cutting unit support member 102 will now be described in more detail with reference to FIG. 4. FIG. 4 shows a cross-sectional view of a cutting unit of the prior art hair cutting apparatus 100 and the prior art hair guide 200 along the line A-A shown in FIG. 3. More generally, FIG. 4 shows a radially extending cross section of the annular cutting zone 114 of the cutting unit 106 supported by the cutting unit support member 102 and the annular hair guiding zone 214 of the annular hair guiding member 206 of the hair guide 200 when the hair guide 200 is coupled to the cutting unit support member 102.

Figure 4:
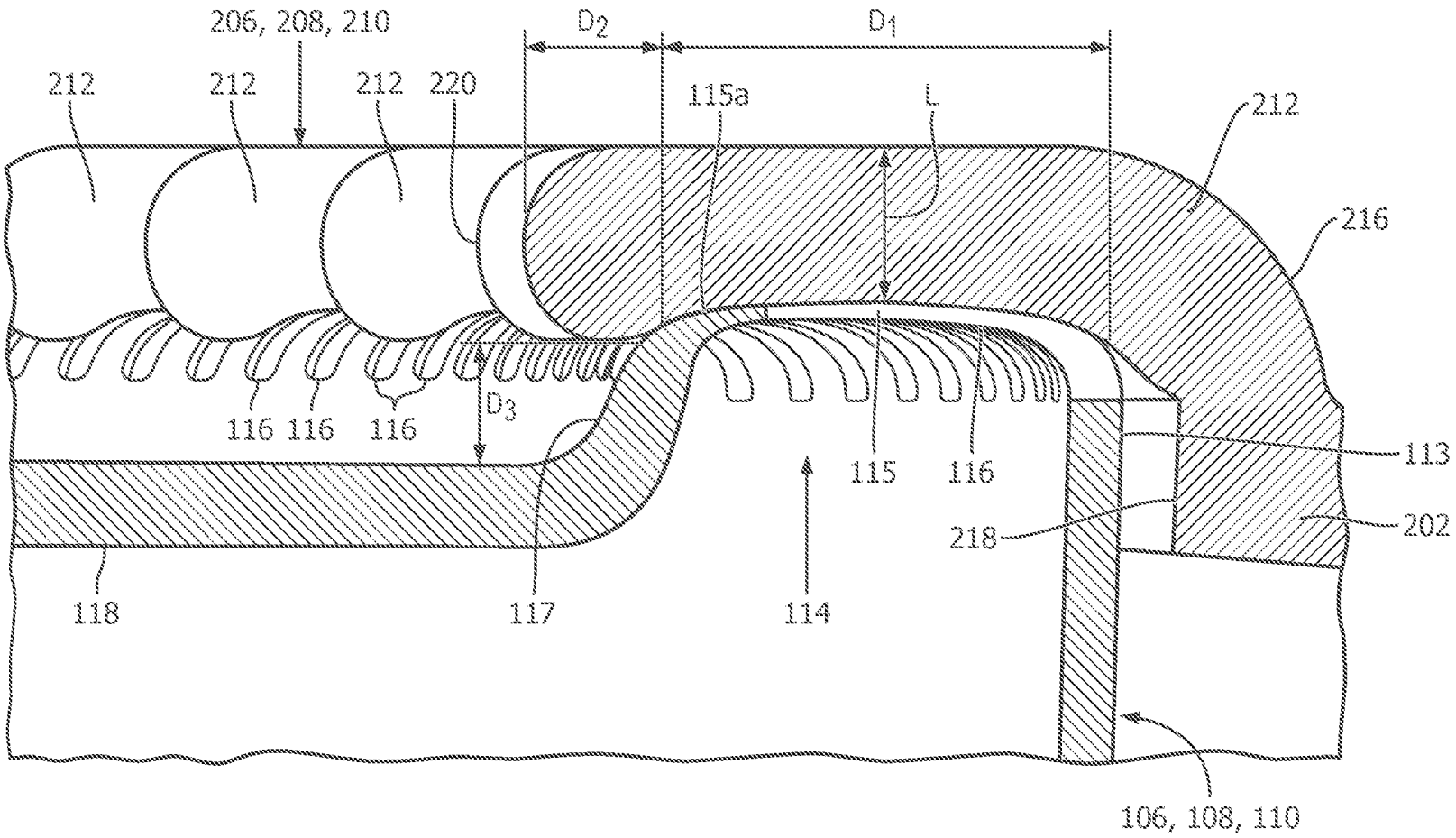
FIG. 4 is a schematic cross-sectional view of a cutting unit of the hair cutting apparatus and the prior art hair guide of FIG. 3 taken along the line A-A of FIG. 3.

As can be seen more clearly in FIG. 4, the annular cutting zone 114 of the external cutting member 112 comprises an inner side wall 117, which surrounds a central wall portion 118 of the external cutting member 112, and an outer side wall 113 which surrounds the main annular wall 115 of the annular cutting zone 114. The inner side wall 117 extends from the main annular wall 115 partially radially inward, relative to the axis of rotation x, and partially axially towards the cutting unit support member 102 such that the central wall portion 118 is recessed relative to the main annular wall 115. Thus, the inner side wall 117 forms a stepped or sloped transition between the main annular wall 115 and the central wall portion 118. The area of the central wall portion 118 adjacent the inner side wall 117 may therefore be referred to as an annular recessed area of the cutting unit 106. This annular recessed area will be understood to be recessed from the main annular wall 115 by the length of the inner side wall 117 in the axial direction of the axis of rotation x. The outer side wall 113 is surrounded by the hair guide support member 202 and the hair guiding elements 212 of the hair guide 200.

In some arrangements, the central wall portion 118 may be an annular wall which extends in a ring-like manner around a further central element of the cutting unit 106 (not shown). However, in other arrangements, the central wall portion 118 may be a substantially circular wall portion which forms the central area of the cutting unit 106 surrounded by the inner side wall 117 and the main annular wall 115. In such arrangements, it will be understood that an annular area of the central wall portion 118 adjacent the inner side wall 117 will be an annular recessed area.

At the location of each of the annular hair guiding members 206, 208, 210, the hair guide support member 202 of the hair guide 200 has a circular aperture 218 associated with a respective one of the cutting units 106, 108, 110, and into which the respective cutting unit 106, 108, 110 may be at least partially received, when the hair guide 200 is attached to the cutting unit support member 102.

A plurality of hair guiding elements 212 extend generally radially inward above the circular aperture 218 to form an annular comb along the periphery of each circular aperture 218 as can be seen in FIGS. 2 and 3. Each aperture 218 and its respective hair guiding elements 212 form an annular hair guiding member 206, 208, 210.

When the hair guide 200 is attached to the cutting unit support member 102 as shown in FIG. 4, each of the hair guiding elements 212 is arranged over the main annular wall 115 of the respective cutting unit 106, 108, 110. Thus, the annular hair guiding members 206, 208, 210 are arranged relative to the hair guide support member 202 of the hair guide 200 such that, when the support member 202 is coupled to the cutting unit support member 102, the annular hair guiding members 206, 208, 210 are each associated with a respective one of the cutting units 106, 108, 110 such that the plurality of hair guiding elements 212 partially cover the main annular wall 115 of the associated cutting unit.

In the arrangement shown in FIG. 4, the hair guiding elements 212 further comprise an inwardly directed rounded end portion 220. The rounded end portion 220 is at a radially inner end of the hair guiding element 212 opposite to the root portion 216 and extends over a radial distance D2.

The rounded end portion 220 is arranged at a distance from the central axis y such that, when the hair guide 200 is coupled to the hair cutting apparatus 100, the rounded end portion 220 is positioned at least partially inwardly of the inner side wall 117 of the annular cutting zone 114 of the associated cutting unit in the radial direction relative to the central axis y. Thus, the rounded end portion 220 at least partially overlies the annular recessed area formed by the central wall portion 118 when viewed in plan containing the central axis y.

It should be understood, however, that the areas of the cutting units 106, 108, 110 above the central wall portions 118 are substantially open, i.e. that the central wall portions 118 are not substantially covered by the hair guiding elements 212 of the hair guide 200. This open central area for each of the cutting units 106, 108, 110 allows free access of hairs into the interspaces between the rounded end portions 220 of the hair guiding elements 212 and further into the hair-entry openings 116 provided in the main annular wall 115.

Furthermore, the rounded end portions 220 are also positioned, in an axial direction relative to the central axis y, at a distance D3 from the annular recessed area of the central wall portion 118 adjacent the inner side wall 117 of the associated cutting unit. In other words, in said axial direction the rounded end portion 220 is spaced from the annular recessed area and from the central wall portion 118 by said distance D3. Accordingly, the rounded end portion 220 of each hair guiding element 212 overhangs the annular recessed area of the central wall portion 118 by the distance D3 and protrudes radially inwards from the main annular wall 115 unsupported by any part of the associated cutting unit 106, 108, 110 or the support member 202.

As a result of the specific arrangement of the rounded end portions 220 overhanging the annular recessed area of the central wall portions 118 of the cutting units 106, 108, 110 as described here before, the cutting units 106, 108, 110 are able to receive hairs more easily in their central areas. Hairs are not masked in these central areas and can be guided from these central areas towards the annular cutting zones 114 when the hair cutting apparatus 100 with the hair guide 200 coupled thereto are moving in any direction relative to the skin and hair growth direction.

As the hair guiding elements 212 extend radially inward and are distributed along the circumference of the cutting unit 106, the hair guiding elements 212 necessarily extend in different directions relative to the skin. This poly-directional arrangement of the hair guiding elements 212 enables the lifting and catching of hairs independent of their hair growth direction. This can be particularly useful for inexperienced users, as the hair cutting apparatus can cut hairs effectively without requiring consistent movement along strokes in the same direction.

The rounded end portions 220 of the hair guiding elements 212 also improve the user's skin comfort when using the hair guide 200. In particular, the rounded end portions 220 may be provided with a hemi-spherically domed end surface such that the rounded end portions 220 have no hard or sharp edges, which might snag on hairs or irritate the user's skin as the hair guiding elements 212 contact the skin and move relative to the skin.

Accordingly, the hair guide 200 provides a more comfortable, efficient, and easier hair cutting system which may be useable by less experienced users and by more experienced users alike.

In the prior art hair guide 200 shown in FIGS. 2 to 4, each of the plurality of hair guiding elements 212 has a rounded end portion 220 as discussed in detail here before. It is noted that, in other arrangements, not all of the plurality of hair guiding elements 212 may have such a rounded end portion 220.

Further, although in the prior art hair guide 200 shown in FIGS. 2 to 4 the rounded end portions 220 of all hair guiding elements 212 are arranged at an equal distance from the central axis y of the annular hair guiding member 206, 208, 210, in alternative arrangements the rounded end portions of the hair guiding elements may be arranged at different distances from the central axis y.

Further, although in the hair guide 200 shown in FIGS. 2 to 4 the hair guiding elements 212 are arranged in the annular hair guiding zone 214 with an equal distance between each pair of adjacent hair guiding elements, in alternative arrangements pairs of adjacent hair guiding elements may instead be arranged with different mutual distances.

Further, although in the prior art hair guide 200 shown in FIGS. 2 to 4 the hair guiding elements 212 each have an equal shape and equal dimensions, in alternative arrangements the hair guide may have hair guiding elements that have mutually different shapes or mutually different dimensions.

Further, although in the prior art hair guide 200 shown in FIGS. 2 to 4 the three annular hair guiding members 206, 208, 210 are substantially identical, in alternative arrangements the hair guide may have two or more annular hair guiding members that are configured in different manners. For example, the annular hair guiding members may have a different number of hair guiding elements or hair guiding elements of different shapes and sizes, for example to adapt the hair-guiding properties of each individual annular hair guiding member of the hair guide to the properties of the individual cutting units 106, 108, 110 of the hair cutting apparatus 100 in case the properties of the cutting units are mutually different.

In the prior art arrangements depicted in FIGS. 2 to 4, the hair guide 200 is configured such that the annular hair guiding members 206, 208, 210 are positioned with a fixed relationship relative to the cutting unit support member 102 of the hair cutting apparatus 100, when the hair guide 200 is coupled to the cutting unit support member 102. Hence, although the cutting units 106, 108, 110 and skin support rims 107, 109, 111 may be pivotable relative to the cutting unit support member 102 in order to conform to the contours of the user's skin, the annular hair guiding members 206, 208, 210 and associated hair guiding elements 212, which lie over the cutting units and skin support rims, are not able to move in the same way. This can lead to peaks in the pressure being applied to the user's skin during hair cutting, particularly when cutting hair on convex areas of skin.

Figure 5:
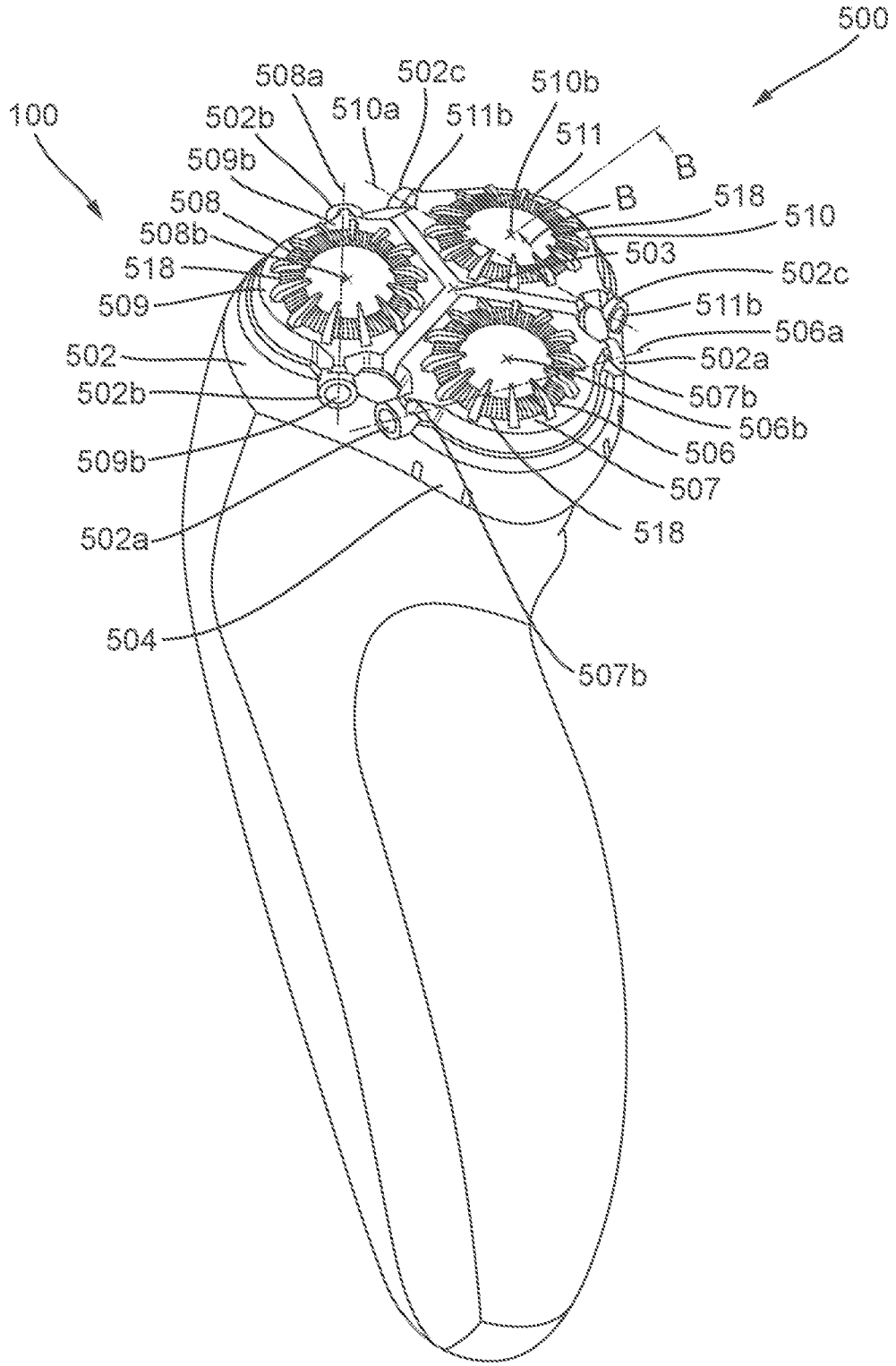
FIG. 5 is a schematic perspective view of a hair cutting system according to the invention comprising a hair guide according to the invention attached to the hair cutting apparatus of FIG. 1.

With reference to FIG. 5, a hair guide 500 in accordance with an embodiment of the present invention comprises a hair guide support member 502 in the form of a main body of the hair guide 500. The hair guide support member 502 may be similar to the hair guide support member 202 of the prior art hair guide 200 described above and the features described in relation to the hair guide support member 202 of the prior art hair guide 200 may apply equally to the hair guide support member 502.

The hair guide support member 502 comprises a coupling portion 504 configured to releasably couple to the coupling member 120 provided on the cutting unit support member 102, or a coupling portion provided on the handle 104 of the hair cutting apparatus 100, in order to releasably couple the hair guide 500 to the hair cutting apparatus 100 over the cutting units 106, 108, 110 and the skin support rims 107, 109, 111.

The hair guide 500 differs from the prior art hair guide 200 in that each annular hair guiding member 506, 508, 510 is pivotally mounted on the hair guide support member 502. As a result, when the hair guide support member 502 is coupled to the hair cutting apparatus 100, the annular hair guiding members 506, 508, 510 are pivotable, together with the respective cutting units 106, 108, 110, relative to the cutting unit support member 102 of the hair cutting apparatus 100. In this way, the annular hair guiding members 506, 508, 510 can pivot, in order to conform to the shape of a user's skin during hair cutting.

In the arrangement shown in FIG. 5, the annular hair guiding members 506, 508, 510 are pivotally mounted on the hair guide support member 502, such that each of the annular hair guiding members 506, 508, 510 is pivotable about a respective pivot axis 506*a*, 508*a*, 510*a* that is perpendicular to a line between a centre 506*b*, 508*b*, 510*b* of the respective annular hair guiding member and a centre point 503 between all of the annular hair guiding members.

In the arrangement shown, three annular hair guiding members 506, 508, 510 are provided, and hence, the pivot axis of each of the annular hair guiding members is arranged at 120 degrees relative to the pivot axes of the other annular hair guiding members.

As described above, when the hair guide 500 is coupled to the cutting unit support member 102, the annular hair guiding members 506, 508, 510 of the hair guide 500 are each associated with a respective one of the cutting units 106, 108, 110 of the hair cutting apparatus 100. The pivot axes 506*a*, 508*a*, 510*a* of the respective annular hair guiding members may be parallel to, or aligned with, the pivot axes 106*a*, 108*a*, 110*a* of the corresponding cutting units. The respective annular hair guiding members 506, 508, 510 are therefore able to pivot together with the corresponding cutting unit 106, 108, 110.

Each annular hair guiding member 506, 508, 510 comprises a respective annular support element 507, 509, 511 and a plurality of hair guiding elements 512. In the illustrated embodiment, the hair guiding elements 512 extend upwardly and radially inwardly from the respective annular support element 507, 509, 511. The hair guiding elements 512 are equidistantly spaced apart around the annular support elements 507, 509, 511 and are fixed to or integrally formed with the annular support elements 507, 509, 511.

The hair guiding elements 512 taper inwardly towards rounded end portions 520, which end portions 520 together surround circular hair receiving apertures 518 provided in the annular support elements 507, 509, 511. The rounded end portions 520 ensure smooth passage of the annular hair guiding members 506, 508, 510 over the skin. Other shapes and spacing of the hair guiding elements 512 are contemplated. For example, the hair guiding elements 512 of a respective annular hair guiding member 506, 508, 510 may meet at a central hub, (not shown) rather than defining the circular apertures 518. This arrangement would increase the integrity of the annular hair guiding members 506, 508, 510, but may block hair from reaching the cutting units 106, 108, 110.

The annular hair guiding members 506, 508, 510 are pivotally coupled to the hair guide support member 502. For this purpose, as depicted in FIG. 5, the annular support elements 507, 509, 511 comprise trunnions 507*b*, 509*b*, 511*b*, which protrude radially outwardly from the annular support elements 507, 509, 511, to be received within slots formed in projections 502*a*, 502*b*, 502*c* on the hair guide support member 502.

As shown, each annular support element 507, 509, 511 comprises two trunnions 507*b*, 509*b*, 511*b* which extend in diametrically opposed directions from the annular support elements 507, 509, 511. The trunnions 507*b*, 509*b*, 511*b* of the annular support elements 507, 509, 511 define the positions of the pivot axes 506*a*, 508*a*, 510*a* of the respective annular hair guiding members 506, 508, 510.

The trunnions 507*b*, 509*b*, 511*b* and the slots may be round, or at least partially round, in cross-section, to permit the trunnions to rotate or pivot within the corresponding slots. The annular hair guiding members 506, 508, 510 are thereby pivotally supported relative to the hair guide support member 502.

Although in the arrangement shown, the trunnions 507*b*, 509*b*, 511*b* are formed on the annular support elements 507, 509, 511, and the slots to receive the trunnions are formed on the hair guide support member 502, it is equally envisaged that in other arrangements, trunnions may be formed on the hair guide support member 502 and the annular support elements 507, 509, 511 may comprise slots for receiving the trunnions.

Further, although in the arrangements shown, the trunnions 507*b*, 509*b*, 511*b* protrude radially outwardly from the annular support elements 507, 509, 511, it is equally envisaged, that the trunnions or slots may be formed in a side wall, e.g. radially outer, side wall of the annular support elements 507, 509, 511. For example, bores or slots may be formed in the annular support elements 507, 509, 511 and trunnions formed on the hair guide support member 502 may protrude into the slots.

As described above and with reference to FIGS. 2 and 6, the annular hair guiding members 506, 508, 510 each comprise a plurality of hair guiding elements 512 arranged circumferentially about circular apertures 518 provided in the annular support elements 507, 509, 511. The circular apertures 518 and the hair guiding elements 512 may be similar to the circular apertures 218 and the hair guiding elements 212 of the prior art hair guide 200 described above with reference to FIGS. 2 to 4 and the features described in relation to the circular apertures 218 and the hair guiding elements 212 may apply equally to the circular apertures 518 and the hair guiding elements 512.

Figure 6:
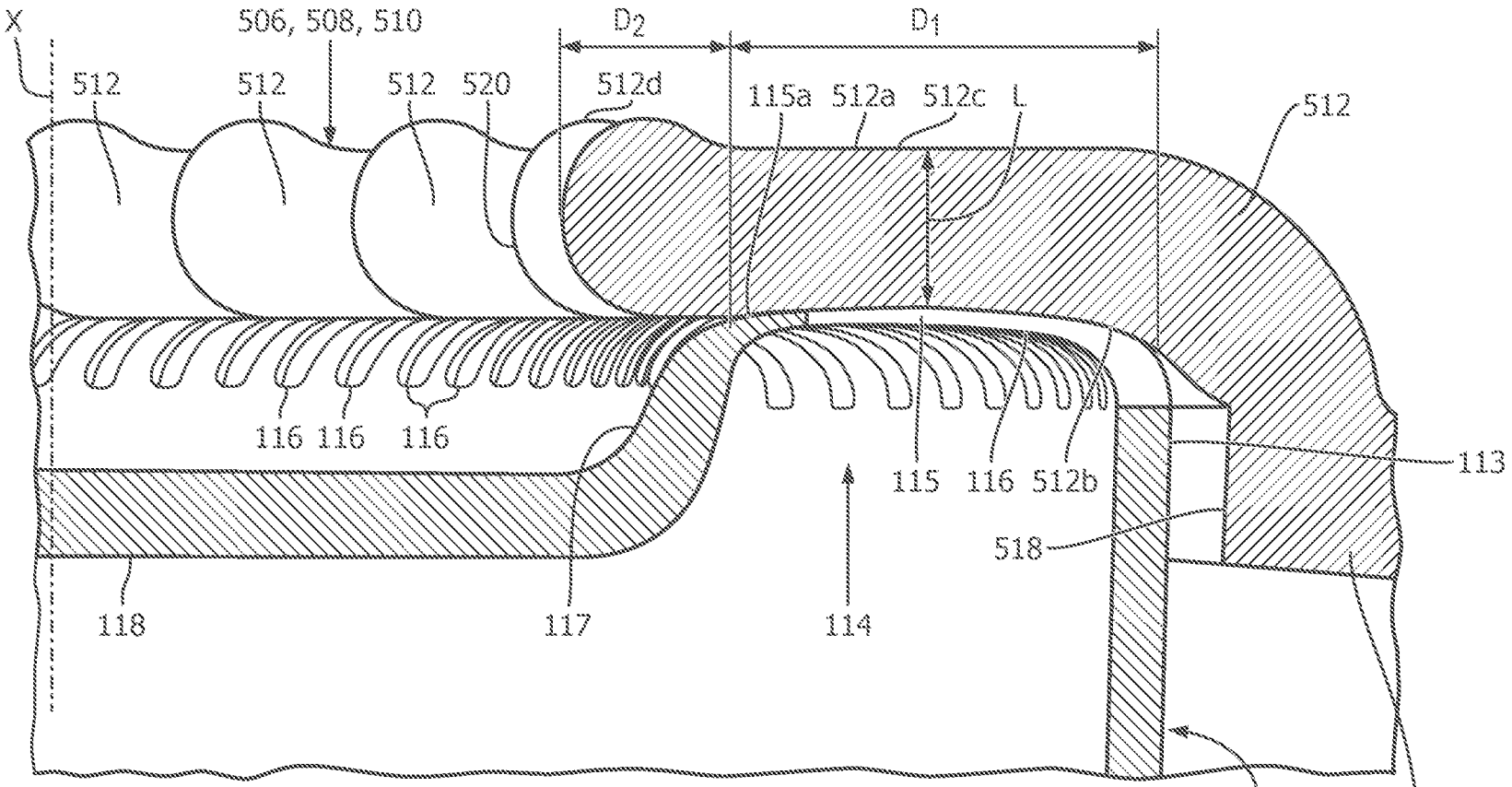
FIG. 6 is a schematic sectional view of the hair guide and a cutting unit of the hair cutting apparatus of FIG. 5 taken along the line B-B of FIG. 5.

With reference to FIG. 6, each hair guiding element 512 has an upper surface 512*a* and a lower surface 512*b*. When the hair guide 500 is coupled to the cutting unit support member 102 of the hair cutting apparatus 100, a portion of the lower surface 512*b* of the hair guiding element 512 is in contact with the external surface 115*a* of the main annular wall 115 of the associated cutting unit of the hair cutting apparatus 100 at a middle region 512*c* of the hair guiding element 512. The middle region 512*c* extends over a radial distance or length D1, which spans a majority of the radial extension of the main annular wall 115 relative to the axis of rotation x.

The hair guiding elements 512 of the hair guide 500 according to the invention may differ from the hair guiding elements 212 of the prior art hair guide 200 in that the hair guiding elements 512 may comprise outwardly directed rounded end portions 520, instead of the inwardly directed rounded end portions 220 provided on the hair guiding elements 212. The outwardly directed rounded end portions 520 are formed by distal portions 512*d* of the hair guiding elements 512 shaped to project outwardly relative the external cutting members 112, e.g. away from the external cutting members 112, over length D2 when the hair guide 500 is coupled to the hair cutting apparatus. In other words, the distal portions 512*d* of the hair guiding elements may extend in a direction with a component away from the external surface of the external cutting member 112, e.g. with a component in a direction parallel with the axis of rotation x of the associated cutting unit. The outwardly directed rounded end portions 520 may otherwise be similar to the inwardly directed rounded end portions 220.

The outwardly directed rounded end portions 520 may be substantially hemispherical. Alternatively, the outwardly directed rounded end portions 520 may comprise one or more flat faces, e.g. on lateral side faces of the hair guiding elements 512.

As depicted in FIG. 6, the distal portions 512*d* of the hair guiding elements 512 may be arranged inward of the main annular wall 115, e.g. relative to the axis of rotation x. The outwardly directed rounded end portions 520 therefore overlie the annular recessed area formed by the central wall portion 118. In some arrangements, the distal portion 512*d* may extend, e.g. radially, inwardly over part of the main annular wall 115.

Shaping the distal portions 512*d* of the hair guiding elements 512 to project outwardly away from the external cutting members 112 in this way improves the ability of the hair guiding elements 512 to lift and guide hairs toward the hair-entry openings 116 when the annular hair guiding members 506, 508, 510 have pivoted together with the cutting units 106, 108, 110, particularly when the annular hair guiding members and cutting units have pivoted such that the external surfaces of the cutting units define parts of a concave surface.

As depicted in FIG. 6, when the distal portion 512*d* of the hair guiding element 512 is shaped to project away from the external cutting member 112, both the upper and lower surfaces 512*a*, 512*b* of the hair guiding elements 512 may extend in a direction with a component outwardly away from the external cutting member 112, e.g. with a component in the direction of the axis of rotation x away from the external cutting member 112.

Figure 7:
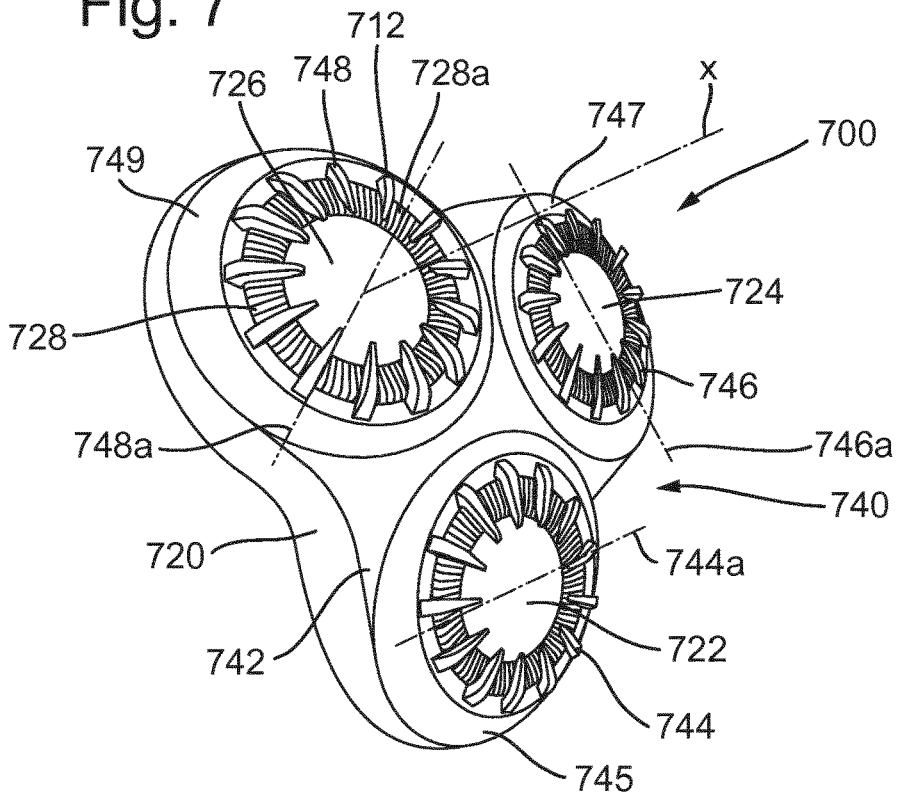
FIG. 7 is a schematic perspective view of a hair cutting assembly according to the invention.

With reference to FIG. 7, a hair cutting assembly 700 according to the invention, e.g. a hair trimming accessory, comprises a cutting unit support member 720 and a hair guide 740 according to the invention. The cutting unit support member 720 is similar to the cutting unit support member 102 of the hair cutting apparatus 100 described above with reference to FIG. 1 and supports three cutting units 722, 724, 726 which are pivotably mounted relative to the cutting unit support member 102.

The cutting units 722, 724, 726 are similar to the cutting units 106, 108, 110 described above. In particular, the cutting units 722, 724, 726 each comprise an external cutting member 728, which is similar to the external cutting member 112, and an internal cutting member (not shown), arranged beneath the external cutting member 728. The internal cutting member is rotatable relative to the external cutting member about an axis of rotation x [please insert ref in FIG. 7] in order to cut hairs that enter the respective cutting unit via hair-entry openings 728*a* formed in the external cutting member.

The hair cutting assembly 700 may be releasably couplable to a main body or handle of a hair shaving or trimming appliance, such as the handle 104, to enable the cutting units 722, 724, 726, e.g. the internal cutting member of the cutting units, to be driven by an actuator accommodated in the handle. For this purpose, the cutting unit support member 720 may be provided with suitable coupling elements for coupling with co-operating coupling elements provided on the main body of the hair shaving or trimming appliance.

The hair guide 740 is similar to the hair guide 500 as described here before and comprises a hair guide support member 742 and three annular hair guiding members 744, 746, 748. The annular hair guiding members 744, 746, 748 are similar to the annular hair guiding members 506, 508, 510. Each annular hair guiding member 744, 746, 748 comprises a respective annular support element 745, 747, 749 and a plurality of hair guiding elements 712. The annular support elements 745, 747, 749 are each pivotally mounted on the hair guide support member 742, such that the annular hair guiding members 744, 746, 748 can pivot about respective pivot axes 744*a*, 746*a*, 748*a* relative to the hair guide support member 742 and thereby follow the contours of a user's skin. The pivot axes 744*a*, 746*a*, 748*a* may be realized by any suitable pivot structure arranged between each of the annular support elements 745, 747, 749 and the hair guide support member 742. The pivot structures are not shown in detail in FIG. 7.

The hair guiding elements 712 may be fixedly coupled to, or integrally formed with, the corresponding annular support elements 745, 747, 749, so that there is a fixed, i.e. a stationary, relationship between the hair guiding elements 712 and the corresponding annular support element 745, 747, 749.

The hair guide 740 differs from the hair guide 500 in that the hair guide support member 742 is arranged in a fixed position relative the cutting unit support member 720. In other words, the hair guide 740 may not be detachable from the cutting unit support member 720 (other than by disassembling the hair cutting assembly 700). In the arrangement shown in FIG. 7, the hair guide support member 742 is formed integrally with the cutting unit support member 720 to form a single part together with the cutting unit support member 720.

In the hair cutting assembly 700, having the hair guide support member 742 fixedly coupled to or integrally formed with the cutting unit support member 720, the cutting units 722, 724, 726 are each supported by a respective one of the annular support elements 745, 747, 749 of the hair guide 740. As depicted, the annular support elements 745, 747, 749 surround the respective cutting units 722, 724, 726 in order to support the cutting units.

Because the hair guide 740 is arranged in a fixed position relative to the cutting unit support member 720 of the hair cutting assembly 700, the cutting units 722, 724, 726, e.g. the external cutting members 728 of the cutting units, may not contact the user's skin during normal use. Instead, the hair guide 740 contacts the user's skin, and the external surfaces of the cutting units 722, 724, 726 are spaced apart from the user's skin by approximately the thickness of the hair guiding elements 712 of the annular hair guiding members 744, 746, 748. This arrangement allows the hair cutting assembly 700 to be used to trim a user's hair to a length approximately equal to the thickness of the hair guiding elements 712 at the location where the annular hair guiding members 744, 746, 748 overly the main annular wall of the external cutting member 728 in the same way as the hair guides 200, 500 described above.

Furthermore, because the user's skin is spaced apart from the cutting units 722, 724, 726 during normal use of the hair cutting assembly 700, the size, e.g. width, of the hair-entry openings 728*a* of the external cutting element 728 can be increased, i.e. compared to the hair-entry openings 116 provided on the external cutting member 112, without risk of increasing abrasions or irritations of the user's skin.

By increasing the size of the hair-entry openings 728*a*, hair can be received and cut by the cutting units 722, 724, 726 more quickly and efficiently than by the cutting units 106, 108, 110.

As depicted in FIG. 7, when the hair guide support member 742 is fixedly coupled to or integrally formed with the cutting unit support member 720, the annular support elements 745, 747, 749 may be configured to perform the same function as the skin support rims 107, 109, 111 of the hair cutting apparatus 100 described above with reference to FIG. 1 in supporting and stretching the user's skin during shaving. The annular support elements 745, 747, 749 may be coupled to, formed integrally with or may replace the skin support rims. In any case, the annular support elements 745, 747, 749 may be configured such that the external surfaces of the annular support elements, that contact the user's skin during shaving, have substantially the same shape as the skin support rims 107, 109, 111, at least in the area immediately around the cutting units 722, 724, 726. This allows the reach of the hair cutting assembly 700 to be substantially the same as the cutting unit support member 102 described above.

Figure 8:
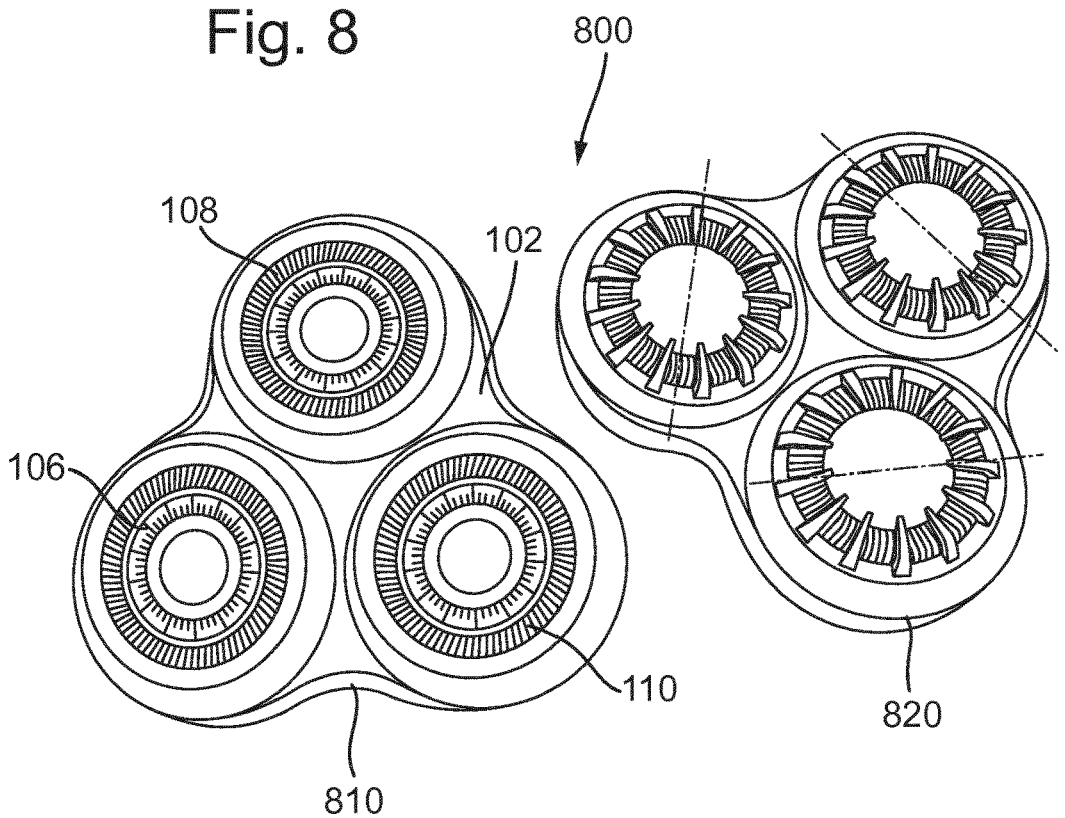
FIG. 8 is a schematic perspective view of a kit of parts for a hair cutting system according to the invention.

With reference to FIG. 8, a kit of parts 800 for a hair cutting system according to the invention comprises a first hair cutting accessory 810 and a second hair cutting accessory 820. The first hair cutting accessory 810 comprises the cutting unit support member 102 and three cutting units 106, 108, 110 supported by the cutting unit support member 102, similar to the cutting unit support member 102 and the cutting units 106, 108, 110 described here before with reference to the hair cutting apparatus of FIG. 1. The cutting unit support member 102 is provided with suitable coupling elements for a releasable coupling of the first hair cutting accessory 810 to the main body of a hair cutting system. The second hair cutting accessory 820 comprises the hair cutting assembly 700 as described here before with reference to FIG. 7. As described above, both of the cutting unit support member 102 and the hair cutting assembly 700 are releasably couplable to the main body or handle 104 of a hair cutting system. Hence, the first and second hair cutting accessories 810, 820 may be interchangeably coupled to the handle 104 to provide a hair cutting system configured to shave or trim a user's hair depending on the hair cutting accessory currently coupled to the handle 104. The kit of parts 800 may further comprise the handle 104.

In the kit of parts 800 shown in FIG. 8, the hair-entry openings of the cutting units provided in the second hair cutting assembly 820 may have a greater width than the hair-entry openings of the cutting units provided in the first hair cutting accessory 810.

In other arrangements, the kit of parts 800 may comprise the hair guide 500 instead of or in addition to the second accessory 820. The hair guide 500 may be configured to couple to the first accessory 810, in the manner described above.

In the arrangements shown in the Figures, the hair cutting apparatus 100 and the hair cutting assembly 700 comprise three cutting units 106, 108, 110, 722, 724, 726 and the hair guides 200, 500, 740 comprise three annular hair guiding members 206, 208, 210, 506, 508, 510, 744, 746, 748, which are arranged relative to the hair guide support member 202, 502, 742 such that, when the hair guides 200, 500 are coupled to the cutting unit support member 102, each of the three annular hair guiding members is associated with a respective one of the three cutting units such that the hair guiding elements 212, 512 partially cover the main annular wall 115 of the associated cutting unit. In alternative embodiments the hair guide may comprise a different number of annular hair guiding members, for example two or four annular hair guiding members for use together with a hair cutting apparatus 100 or hair cutting assembly 700 having, respectively, two or four cutting units. In other embodiments the hair guide may comprise a number of annular hair guiding members which is smaller than the number of cutting units of the hair cutting apparatus with which it co-operates. In such embodiments, when the hair guide is coupled to the hair cutting apparatus, not all of the cutting units of the hair cutting apparatus are associated with an annular hair guiding member of the hair guide, and one or more of the cutting units may for example not be covered by an annular hair guiding member of the hair guide. In another variant of the hair guide, in at least one of the annular hair guiding members the plurality of hair guiding elements are provided only in a particular angular sector of the annular hair guiding member, while no hair guiding elements are provided in the remaining angular portion of the annular hair guiding member.

It is clear for the person skilled in the art that different hair cutting apparatuses will have cutting units of different sizes. Such cutting units are well known, so it will be understood how the hair guide according to the invention and the parts and dimensions thereof can be adapted to suit the particular cutting units of different hair cutting apparatuses. Thus, it is appropriate in this instance to define particular features of the hair guide according to the invention with reference to features of the hair cutting apparatus with which it will be associated.

It will be appreciated by those skilled in the art that although the invention has been described by way of example, with reference to one or more exemplary examples, it is not limited to the disclosed examples and that alternative examples could be constructed without departing from the scope of the invention as defined by the appended claims.

The invention claimed is:

1. A hair guide for a hair cutting assembly, wherein the hair cutting assembly comprises a cutting unit support member and at least two cutting units, wherein each of the cutting units has an external cutting member and an internal cutting member which is rotatable relative to the external cutting member about an axis of rotation, the external cutting member having an annular cutting zone comprising hair-entry openings provided at least in a main annular wall of the cutting zone, and wherein each of the cutting units is pivotable relative to the cutting unit support member, said hair guide comprising:

a hair guide support member configured to be coupled to the cutting unit support member of the hair cutting assembly, and at least two annular hair guiding members, each of the at least two annular hair guiding members having a central axis and a plurality of hair guiding elements having a main direction of extension in a radial direction relative to the central axis and arranged in an annular hair guiding zone extending about the central axis, wherein each of the at least two annular hair guiding members is arranged relative to the hair guide support member such that, when the hair guide support member is coupled to the hair cutting assembly, each of the at least two annular hair guiding members is associated with a respective one of the at least two cutting units of the hair cutting assembly such that the plurality of hair guiding elements partially cover the main annular wall of the resat least two cutting units, and wherein each of the at least two annular hair guiding members is pivotable relative to the hair guide support member such that, when the hair guide support member is coupled to the hair cutting assembly, each of the at least two annular hair guiding members is pivotable together with the at least two cutting units.

2. The hair guide as claimed in claim 1, wherein, when the hair guide support member is coupled to the hair cutting assembly, distal portions of the hair guiding elements extend in directions with a component away from an external surface of the external cutting member of the at least two cutting units.

3. The hair guide as claimed in claim 1, wherein each of the at least two annular hair guiding members is pivotable about a pivot axis which is arranged perpendicular to a line extending from a centre of the at least two annular hair guiding members to a centre point between the at least two annular hair guiding members.

4. The hair guide as claimed in claim 3, wherein the at least two annular hair guiding members comprises three annular hair guiding members, wherein the pivot axis of each of the three annular hair guiding members is arranged at 120 degrees relative to the pivot axes of the other annular hair guiding members.

5. The hair guide as claimed in claim 1, wherein, when the hair guide support member is coupled to the hair cutting assembly, each of the at least two annular hair guiding members being pivotable about a pivot axis that is parallel to a pivot axis of a corresponding cutting unit.

6. The hair guide as claimed in claim 1, wherein the annular cutting zone of each of the at least two cutting units further comprises an inner side wall which surrounds a central wall portion of the external cutting member, said central wall portion being recessed relative to the main annular wall at least in an annular recessed area adjacent to the inner side wall, and wherein at least one of the hair guiding elements of each of the two annular hair guiding members has an inwardly directed rounded end portion which is arranged at a distance from the central axis such that, when the hair guide support member is coupled to the hair cutting assembly, the rounded end portion is positioned, in a radial direction relative to the central axis, at least partially inwardly of the inner side wall of the at least two cutting units and, in an axial direction relative to the central axis, at a distance from the annular recessed area of the at least two cutting units.

7. The hair guide as claimed in claim 1, wherein the hair guide support member is configured to be detachably couplable to the cutting unit support member of the hair cutting assembly.

8. The hair cutting assembly comprising a hair guide as claimed in claim 1 and further comprising a cutting unit support member pivotably coupled to the hair guide and at least two cutting units, wherein each of the at least two cutting units has an external cutting member and an internal cutting member which is rotatable relative to the external cutting member about an axis of rotation, the external cutting member having an annular cutting zone comprising hair-entry openings provided at least in a main annular wall of the cutting zone, and wherein each of the at least two cutting units is pivotable relative to the cutting unit support member, wherein the hair guide support member is arranged in a fixed position relative to the cutting unit support member.

9. The hair cutting assembly as claimed in claim 8, wherein the hair guide support member is integrally formed with the cutting unit support member.

10. The hair cutting assembly as claimed in claim 8, wherein each annular hair guiding member comprises an annular support element surrounding and supporting the at least two cutting units and being pivotable relative to the hair guide support member, wherein the hair guiding elements each of the at least two annular hair guiding member are arranged in stationary positions relative to the annular support element.

11. The hair cutting apparatus having a hair cutting assembly as claimed in claim 8 releasably couplable to a main body accommodating an actuator for rotatably driving the internal cutting members of the cutting units of the hair cutting assembly.

12. The hair cutting apparatus as claimed in claim 11, wherein the hair cutting assembly is releasably couplable to the main body via a coupling portion configured to releasably couple to a coupling member provided on one of the support member or on a handle of the hair cutting apparatus.

13. A kit of parts for a hair cutting system, the kit comprising:

a first hair cutting accessory comprising a cutting unit support member and at least two cutting units, wherein each of the at least two cutting units has an external cutting member and an internal cutting member which is rotatable relative to the external cutting member about an axis of rotation, the external cutting member having an annular cutting zone comprising hair-entry openings provided at least in a main annular wall of the cutting zone, and wherein each of the at least two cutting units is pivotable relative to the cutting unit support member; and a second hair cutting accessory comprising a hair cutting assembly according to claim 8, wherein the hair-entry openings of the at least two cutting units of the hair cutting assembly of the second hair cutting accessory have a greater width than the hair-entry openings provided in the at least two cutting units of the first hair cutting accessory.

14. The kit of parts of claim 13, further comprising a main body accommodating an actuator for rotatably driving the internal cutting members of the at least two cutting units of the first and second hair cutting accessories, wherein the first and second hair cutting accessories are interchangeably couplable to the main body.

15. A kit of parts for a hair cutting system, the kit comprising:

a hair cutting apparatus comprising a cutting unit support member and at least two cutting units, wherein each of the at least two cutting units has an external cutting member and an internal cutting member which is rotatable relative to the external cutting member about an axis of rotation, the external cutting member having an annular cutting zone comprising hair-entry openings provided at least in a main annular wall of the cutting zone, and wherein each of the at least two cutting units is pivotable relative to the cutting unit support member, the hair cutting apparatus further having a main body accommodating an actuator for rotatably driving the internal cutting members of the at least two cutting units; and a hair cutting accessory comprising a hair guide according to claim 1, wherein the hair guide support member is configured to be detachably couplable to the cutting unit support member of the hair cutting apparatus.

* * * * *